United States Patent [19]

Cargnino et al.

[11] Patent Number: 4,579,560

[45] Date of Patent: Apr. 1, 1986

[54] METHOD FOR DYEING OF FIBERS IN THE PRESENCE OF QUATERNARY ALKOXYALKYLAMMONIUM RETARDING OR LEVELING AGENT

[75] Inventors: Francesco Cargnino, Venaria; Marco Levis, Turin, both of Italy

[73] Assignee: Hoechst Italia S.p.A., Milan, Italy

[21] Appl. No.: 628,250

[22] Filed: Jul. 6, 1984

Related U.S. Application Data

[62] Division of Ser. No. 486,261, Apr. 18, 1983, abandoned.

[30] Foreign Application Priority Data

Apr. 29, 1982 [IT] Italy ..... 21002 A/82

[51] Int. Cl.[4] ..... D06P 3/00

[52] U.S. Cl. ..... 8/539; 8/606; 8/654; 8/657; 8/922; 8/927; 564/286; 564/294

[58] Field of Search ..... 8/539, 606, 654, 657

[56] References Cited

U.S. PATENT DOCUMENTS

| | | | |
|---|---|---|---|
| 2,759,975 | 8/1956 | Chiddix et al. | 564/285 |
| 3,466,247 | 9/1969 | Ohtsuka et al. | 564/292 |
| 3,968,315 | 7/1976 | Hochreuter | 564/292 |
| 4,126,562 | 11/1978 | Goffinet et al. | 252/8.8 |

FOREIGN PATENT DOCUMENTS 857065 1/1978 Belgium .

852548 10/1960 United Kingdom .

*Primary Examiner*—A. Lionel Clingman

*Attorney, Agent, or Firm*—Connolly and Hutz

[57] ABSTRACT

Novel quaternary alkoxyalkylammonium compounds of the formula 1 in which

R denotes $C_8$–$C_{20}$—, preferably $C_{12}$–$C_{18}$—, alkyl or $C_8$–$C_{20}$—, preferably $C_{12}$–$C_{18}$—, alkenyl, $R_1$, $R'_1$ and $R''_1$, which can be identical or different, denote methyl, ethyl or benzyl and at least one of the radicals $R_1$, $R'_1$ and $R''_1$ denotes a group of the formula $-(C_SH_{2S}O)_xH$, $R_2$ and $R_3$, which can be identical or different, denote methyl, ethyl or benzyl, a denotes 0 or 1, b denotes 0 or 1, of which either a or b has to be=1, m denotes 0 or 1, n denotes 2 or 3, p denotes 1, 2 or 3, S denotes 2 or 3, x denotes 1, 2, 3 or 4, and A denotes a halide, methosulfate, ethosulfate or methophosphate ion. These compounds are used as retarders and leveling agents in the dyeing of polyacrylonitrile and acid-modified polyester fibers.

4 Claims, 3 Drawing Figures

Figure 1:
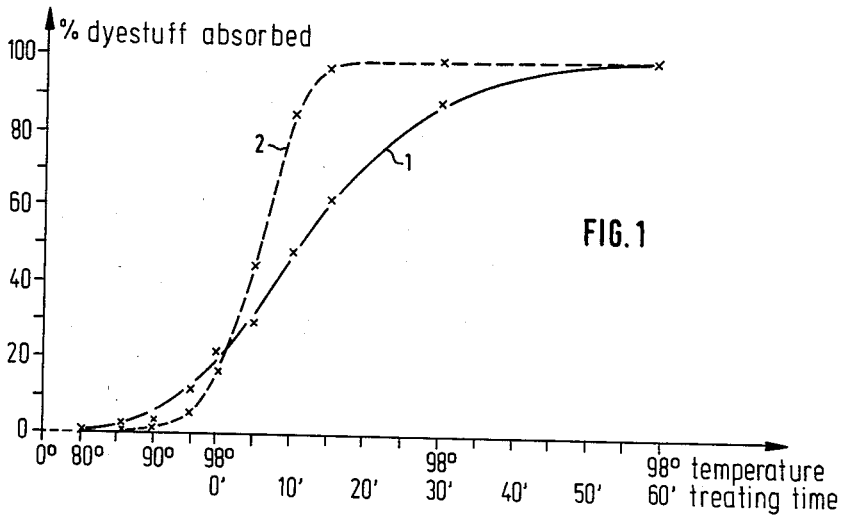

METHOD FOR DYEING OF FIBERS IN THE PRESENCE OF QUATERNARY ALKOXYALKYLAMMONIUM RETARDING OR LEVELING AGENT

CROSS-REFERENCE TO RELATED APPLICATIONS

This application is a divisional of U.S. application Ser. No. 486,261, filed Apr. 18, 1983, now abandoned.

It is known that the dyeing of polyacrylonitrile fibers and of anionically modified polyester fibers with cationic or basic dyestuffs strongly depends on the rate at which the dyestuffs exhaust onto the fiber.

It is also known that in these cases level dyeings are generally only obtained when they are carried out in the presence of leveling agents which are known as retarders. The situation is namely such that the dyestuffs exhaust (or the rate of dyeing) very rapidly (is very high) in the absence of retarders, and consequently nonuniformly. The use of retarders permits a reduction in the rate at which the dyestuffs exhaust, and thereby effects a more uniform and more level dyeing.

It is customary to distinguish between permanent and temporary retarders. The permanent retarders are usually very effective. They form firm bonds with the fibers in competition with the dyestuffs. For this reason they are used only in low concentrations, and their quantity has to be accurately calculated by taking into account the saturation factors of the dyestuffs and of the fiber (true technical equivalents). This type of retarder has the disadvantage that if used in too large an amount it prevents complete exhaustion of the dyestuff liquor or that it makes it difficult to cross-dye already dyed polyacrylonitrile fiber or anionically modified polyester fiber goods in those cases where a further, subsequent dyeing is required. The abovementioned permanent retarders generally consist of quaternary ammonium salts, of which the best known is lauryldimethylbenzylammonium chloride.

In contrast, temporary retarders consist of various products which have a less pronounced ionic charge than the abovementioned ones, and hence the temporary retarders form a somewhat more labile bond with the fiber. Their bond with the active groups of the fiber is such that they can be displaced by the dyestuff, since the latter has more pronounced ionic properties. In other words, unlike the permanent retarders, the temporary retarders block the active sites of the fiber only to a relatively small extent. As is known, the temporary retarders are used in relatively high concentrations, and are unable by themselves to guarantee perfect levelness of the dyeing under all application conditions.

It is therefore an object of the present invention to provide new products which at one and the same time combine the advantages of the two types of retarder without having their disadvantages.

The invention accordingly relates to new quaternary alkoxyalkylammonium compounds of the formula 1

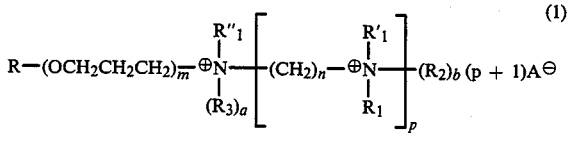

(1)

in which

R denotes $C_8$–$C_{20}$-, preferably $C_{12}$–$C_{18}$-, alkyl or $C_8$–$C_{20}$-, preferably $C_{12}$–$C_{18}$-, alkenyl, $R_1$, $R'_1$ and $R''_1$, which can be identical or different, denote methyl, ethyl or benzyl and at least one of the radicals $R_1$, $R'_1$ and $R''_1$ denotes a group of the formula $-(C_sH_{2s}O)_xH$, $R_2$ and $R_3$, which can be identical or different, denote methyl, ethyl or benzyl, a denotes 0 or 1, b denotes 0 or 1, of which either a or b has to be =1, m denotes 0 or 1, n denotes 2 or 3, p denotes 1, 2 or 3, s denotes 2 or 3, x denotes 1, 2, 3 or 4, and A denotes a halide, methosulfate, ethosulfate or methophosphate ion.

The following are examples of alkyl groups R: decyl, undec-1-yl, undec-4-yl, dodec-1-yl, tridec-1-yl, tetradec-1-yl, tetradec-6-yl, pentadec-1-yl, hexadec-8-yl, heptadec-1-yl, heptadec-9-yl, octadec-1-yl or stearyl, monodec-1-yl, 5-propyldec-1-yl, 3-propyltridec-1-yl and eicosyl. Examples of unsaturated aliphatic ($C_8$–$C_{20}$) groups represented by R in the above formula are dec-1-enyl, dec-9-enyl, dodec-9-en-1-yl, hexadec-9-en-1-yl, octadec-6-en-1-yl, octadec-9-en-1-yl and octadec-11-en-1-yl. Preferable radicals R are decyl, dodec-1-yl, tridec-1-yl, tetradec-1-yl, hexadec-1-yl, stearyl and dec-1-enyl.

Also those radicals R are preferable which are derived from naturally occurring fats, such as, for example, tallow alkyl, coconut alkyl, soybean alkyl, palm oil alkyl or the like. Since these naturally occurring fats are mixtures of compounds of different chain lengths, the radical R in these cases accordingly is a mixture of alkyl or alkenyl groups of different chain lengths.

For the purposes of the present invention, the expressions "product of the formula (1)", "retarders and/or leveling agents of the formula (1)", "product of the present invention" and "retarders and/or leveling agents of the present invention" encompass not only an individual compound which has the formula (1) but also a mixture of two or more compounds of the formula (1), as can also be seen in the examples.

The retarders and/or leveling agents of the present invention are capable of blocking the fiber to an adequate extent, and thus ensuring that the dyestuff exhausts normally. At the same time they are capable of dissolving slowly from the fiber if an excess of dyestuff arises in the dyeing liquor or in the case of an accidental excess dose of retarder and/or leveling agent. The new retarder and/or leveling agent is used in the dyeing of polyacrylonitrile fibers and of anionically modified polyester fibers according to those methods which are generally familiar in the case of permanent retarders.

The optimum amount of retarder and/or leveling agent to be added to the dyeing liquor should be calculated by taking into account the saturation factors of the fiber to be dyed and of the dyestuffs used, which procedure will be generally familiar to those skilled in the art. If retarders of a known type are added to the dyeing process with which the present invention concerns itself, in addition to retarders and/or leveling agents of the formula 1, the former should always be present in an amount which is less than that of the compounds according to the invention.

The polyacrylonitrile or anionically modified polyester fiber material to be dyed can be at various stages of processing, such as, for example, in the form of tows, tops, yarns, or woven or knitted fabrics. The aqueous dyeing liquor contains the necessary amount of dyestuff, electrolytes and possible additives (wetting agents, foam inhibitors and the like) and an amount of retarders and/or leveling agents of the formula 1. The respective amounts depend on the saturation factor of the fiber and of the dyestuff or dyestuffs, on the substantivity of the dyestuff or dyestuffs, and on the characteristics of the dyeing machines used. The liquor ratio is generally between 1:1 and 200:1, preferably between 2:1 and 40:1.

Owing to the fact that the retarders and/or leveling agents of the invention are readily soluble, they can be added directly to the dyeing liquor. The circulating dyeing liquor is heated at a temperature between 80° and 110° C. until complete exhaustion of the dyestuff is ensured. This usually takes between 20 and 120 minutes. The amount of retarder and/or leveling agent is as a rule between 0.1 and 4% by weight, relative to the material to be dyed. The pH of the dyeing liquor is adjusted to values between 1 and 7, preferably between 3 and 6.

The dyeing method of the present invention produces perfectly level dyeings with optimum exhaustion of the dyeing liquor. It is also possible to carry out cross-dyeings or to achieve complete exhaustion of the dyeing liquor, even in cases where the liquor accidentally contains too much retarder and/or leveling agent. However, this excess dosage must not exceed the amount for completely saturating the fiber by more than 30–50%. Another point which should be emphasized is that, when only slightly substantive dyestuffs are used, the concentration of the retarder and/or leveling agent in the dyeing liquor can be reduced in order to avoid excessively long dyeing times.

German Offenlegungsschrift 2,633,138 describes a process for preparing level dyeings on polyacrylonitrile or acid-modified polyester fibers, in which, this material is treated with basic dyestuffs in the presence of leveling agents of the formula (2)

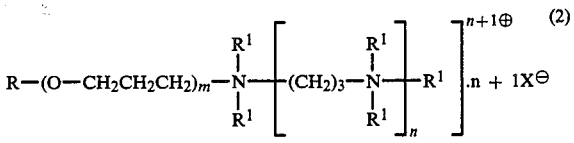

(2)

in which

R represents an aliphatic saturated or unsaturated radical having 10–20 carbon atoms, $R^1$ represents on average 0–20% of hydrogen and 100–80% of methyl or ethyl, $X^{\ominus}$ represents one equivalent of an anion, n represents the numbers 1 or 2 and m represents the numbers 0 or 1.

These products, however, are temporary retarders which are afflicted with the disadvantages characteristic of this class of retarder. In Examples 9, 10 and 11, below, some typical representatives of these retarders are compared with the retarders and/or leveling agents of this invention.

The retarders and/or leveling agents of the present invention can be prepared as described in "Cationic Surfactants", edited by Eric Jungermann, Marcel Dekker Inc., New York (1970), page 29, namely by reacting compounds of the formula (3)

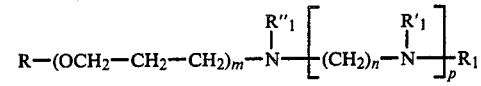

(3)

with alkylating agents. The reaction takes place in the presence of alkali in an aqueous medium or in an organic solvent. Examples of suitable organic solvents are lower aliphatic alcohols, ethers, in particular cyclic ethers, such as tetrahydrofuran or dioxane, and benzene derivatives, such as benzene, toluene, xylene or chlorinated benzenes. Specific examples of alkalis are alkali metal hydroxides and alkali metal carbonates. The reaction is preferably carried out in an aqueous medium in the presence of sodium hydroxide.

Preferred alkylating agents are methyl or ethyl halides, preferably chloride, dimethyl or diethyl sulfate or trimethyl or triethyl phosphate. The alkylation reaction is generally carried out at temperatures between 55° and 100° C., preferably between 80° and 95° C. If a complete quaternization is desired, it is advisable to use an excess of alkylating agent. After the alkylation, the excess of alkylating agent can be removed from the reaction mixture by evaporating it, for example when alkyl halides are used. It is also possible to inject into the alkylation, for example with alkyl halides, alkylating agents until the vapor pressure of the alkylating agent has become established in the reaction vessel at the reaction temperature. If, on the other hand, a complete quaternization is not desired, it is also possible to use less than the stoichiometric amount of alkylating agent. In this case, one obtains compounds of the formula (1) in which either a or b=0. The amount of alkali used in the alkylation is at least equivalent to the amount of alkylating agent consumed, and in general it is in a slight excess. When the alkylation reaction has ended, the excess amount of alkali is neutralized by adding acid. The examples which follow serve to illustrate the invention in more detail. The parts are parts by weight, unless otherwise stated.

EXAMPLE 1

N'-Alkyl-N',N''-trihydroxyethyl-N',N''-dibenzylpropylenediammonium chloride 448 parts of N'-alkyl-N',N''-trihydroxyethylpropylenediamine ("alkyl" is a linear aliphatic chain which derives from hydrogenated tallow and is a mixture of octadecyl, hexadecyl and tetradecyl radicals) are treated at 85° C. with 100 parts of water and 65 parts of 30% strength sodium hydroxide to form a homogeneous paste. 252 parts of benzyl chloride are slowly added between 60°–95° C., preferably between 80°–85° C. The reaction is exothermic, and the rate at which the benzyl chloride is added has therefore to be adjusted in such a way that the temperature does not exceed 95°–98° C., so as to prevent foaming due to the water boiling at 100° C. It is best to work in a reaction vessel which is equipped with a reflux condenser. It is also possible to use a sealed apparatus under a slight superatmospheric pressure. The pH must be kept between 2 and 7, preferably between 4 and 7. The reaction is completed by heating the contents at 80°–100° C., better at between 90°–98° C., until the benzyl chloride has completely disappeared. In this way one obtains 680–690 parts of the desired product in a concentration of 100% by weight, and with a melting point of 80°–95° C.

EXAMPLE 2

N'-Dodecyl-N',N''-trihydroxyethyl-N',N''-dibenzylpropylenediammonium chloride

Similarly to Example 1, 374 parts (1 mole) of N'-dodecyl-N',N''-trihydroxyethylpropylenediamine are treated at 80° C. with 1,200 parts of water and 65 parts of 30% strength sodium hydroxide to form a homogeneous paste. 252 parts of benzyl chloride (2 moles) are added at between 60°-95° C., preferably between 80°-90° C., and the pH of the reaction mixture is kept, at a temperature between 95° and 98° C. (exothermic), at between 1 and 7, preferably between 4 and 7. To complete the reaction, 250 parts of water are distilled off, thereby also removing about 10 parts of benzyl alcohol which had formed in the course of the reaction.

This gives about 1,640 parts of a liquid product having a solids content of 38%.

EXAMPLE 3

A mixture of N'-octadecenyl-N',N''-trihydroxyethyl-N',N''-dibenzylpropylenediammonium chloride, N'-octadecenyl-N',N''-trihydroxyethyl-N'-monobenzylpropyleneammonium chloride and N'-octadecenyl-N',N''-trihydroxyethyl-N''-monobenzylpropyleneammonium chloride.

Similarly to Example 2, 456 parts (1 mole) of N'-octadecenyl-N',N''-trihydroxyethylpropylenediamine are treated at 60°-90° C., preferably at 70°-80° C., with 1,200 parts of water and 60 parts of 30% strength sodium hydroxide to form a homogeneous paste. 189 parts (1.5 moles) of benzyl chloride are then added between 50°-95° C., preferably 80°-90° C. (exothermic reaction). To complete the reaction, 200 parts of water are distilled off, also removing 8-10 parts of benzyl alcohol which is formed in the course of the reaction. This gives about 1,697 parts of an aqueous solution containing 38% of the reaction product.

EXAMPLE 4

10 g of polyacrylonitrile yarn are boiled for 60 minutes in 400 cc of water which contains per liter in the form of a solution 0.25 g of the commercial dyestuff Basic Red 18 (C.I. No. 11,085), 0.25 g of the retarder of Example 1, and 1 g of acetic acid.

This produces a perfectly level dyeing, and the dyestuff present in the bath exhausts in a slow and gradual manner, while the same treatment in the absence of the retarder leads to an unlevel dyeing and to a rapid exhaustion of the dyebath.

EXAMPLE 5

The method described in Example 4 is repeated, except that the time at the boil is prolonged to 90 minutes and the concentration of the retarder is increased to 0.35 g/liter.

This gives a perfectly level dyeing of the same strength as that obtained in Example 4.

If the novel retarder and/or leveling agent is replaced by equivalent amounts of a cationic retarder which is of a known type and consists of dodecyl-N-dimethylbenzylammonium chloride, this leads to a paler dyeing and to insufficient exhaustion of the dyestuff present in the dyeing liquor.

EXAMPLE 6

100 kg of a polyacrylonitrile fiber which has a saturation factor of 2.1 are dyed in a box-shaped dyeing machine in 2,000 liters of a dyeing liquor which contains 2 kg of acetic acid, 1 kg of the dyestuff C.I. Basic Blue 69, which is highly substantive, and 3.27 kg of the retarder of the present invention in the form of a 38% strength solution prepared in Example 2, in accordance with the following calculation:

Factor of the dyestuff=0.3
Factor of the fiber=2.1
Free factor to be saturated=2.1-0.3=1.8
Factor of the retarder=0.55
Quantity of retarder to be used=1.8:0.55=3.27 kg The dyeing, carried out at the boil in the course of 45 minutes, leads to a gradual and complete exhaustion of the dyeing liquor and to a perfectly level blue shade on the fiber.

EXAMPLE 7

10 g of a polyacrylonitrile fiber are treated for 30 minutes in 400 cc of boiling water which contain per liter in the form of a solution 0.5 g of the dyestuff C.I. Basic Yellow 11, No. 48,055, 0.25 g of the retarder of the present invention as prepared in Example 1, and 1 g of acetic acid.

10 g of the same fiber are treated in a similar manner, but with an equivalent weight of lauryldimethylbenzylammonium chloride.

When they have been dried and conditioned, the fibers have the same shade as the fibers dyed with the retarder and/or leveling agent of the present invention, but they have a higher antistatic value than those which have been dyed with conventional retarders.

EXAMPLE 8

10 g of a polyacrylonitrile fiber which has a saturation factor of 2.1 are boiled for 4-5 minutes in a dyeing liquor which consists of 400 cc of water, 0.1 g of the dyestuff C.I. Basic Red 18, No. 11,085, 0.25 g of the retarder prepared in Example 2 and 0.5 g of acetic acid. Another 10 g of this fiber are dyed in the same manner in the presence of the same amount of the retarder prepared in Example 3.

The dyeing method produces a level dyeing on both sets of fibers, but the rate at which the dyestuff exhausts differs in the two cases, as is shown by the following table:

| | Product of Example 2 | Product of Example 3 |
|---|---|---|
| Start of dyeing | 100 | 100 |
| At 90° C. | 93 | 95 |
| At 98° C. | 82 | 87 |
| After 5 minutes at 98° C. | 68 | 76 |
| After 10 minutes at 98° C. | 51 | 63 |
| After 15 minutes at 98° C. | 41 | 54 |
| After 25 minutes at 98° C. | 23 | 37 |
| After 35 minutes at 98° C. | 7 | 18 |
| After 45 minutes at 98° C. | 1 | 1 |

The numbers in the table represent the percentage dyestuff content in the dyeing liquor at various times, relative to the starting quantity (100%).

It is clear from the table that the quaternization of both the two nitrogen atoms in the molecule of the retarder and/or leveling agent of the formula (1) results in a stronger retarding action.

EXAMPLE 9

100 kg of a polyacrylonitrile fiber are dyed in a dyeing liquor which is composed as follows:

| | |
|---|---|
| Water | 2,000 liters |
| Basic Yellow 28, No. 48,054 | 0.7% (on weight of fiber) |
| Basic Red 81 | 0.18% (on weight of fiber) |
| Basic Blue 41, No. 11,154 | 0.12% (on weight of fiber) |
| Retarder of Example 2 | 2.6% (on weight of fiber) |
| Acetic acid to pH 5 | |

The dyeing method involves heating the dyeing liquor to 98° C. at a rate of 1° C./minute, and keeping the dyeing liquor at the boil for one hour (curve 1 in FIG. 1).

Figure 2:
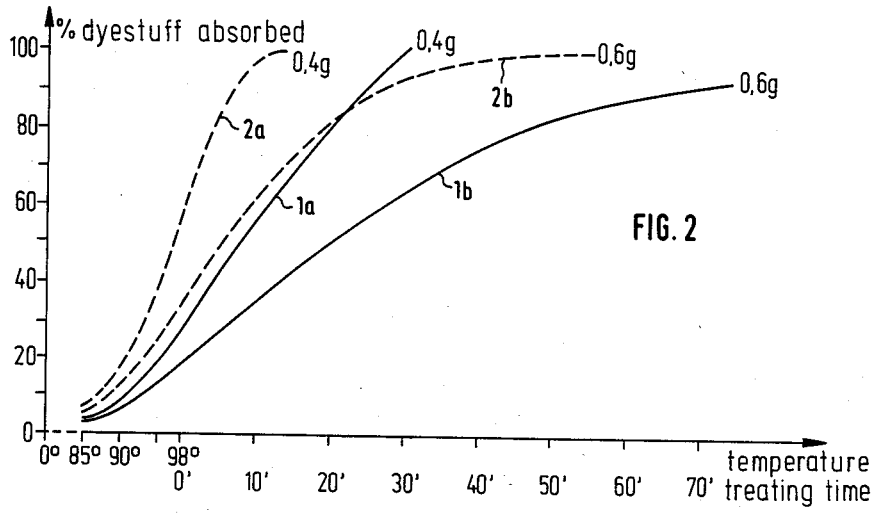

A further 100 kg of a polyacrylonitrile fiber are dyed in the same way with the aid of an identical amount of a conventional retarder (dimethyl coconut benzylammonium chloride) (curve 2 in FIG. 2).

The two cases produce perfectly level dyeings. However, the rate at which the dyestuff exhausts differs substantially, as can be seen from the graph of FIG. 1.

This graph shows that the rate at which the dyestuff exhausts at the boil is very much lower if the retarder of the present invention is used. This fact is an advantage over the conventional permanent retarders, since complete exhaustion of the dyestuff is achieved with a more constant rate of dyeing.

EXAMPLE 10

10 g of a polyacrylonitrile fiber are treated at the boil for 75 minutes in 400 cc of water which contain 0.2 g of the dyestuff Basic Red 46, 0.4 g of the retarder of Example 2, and 0.4 cc of acetic acid.

Another 10 g of the same fiber are treated in parallel fashion in a dyeing liquor which has been prepared in the same way as the first liquor but which contains as retarder 0.4 g of a tallow propylenediamine quaternized with dimethyl sulfate.

Further samples of the same fiber are treated in the same manner with the amount of the two retarders increased to 0.6 g.

The rate of dyeing of the dyestuff is shown in the graph of FIG. 2 (curves 1*a* and 1*b* use the product according to the invention, while curves 2*a* and 2*b* use the prior art product). The differences in the rate of dyeing of the dyestuff show that the product according to the invention is a more effective retarder than an analogous product which has, however, different $R_1$ radicals and is quaternized with dimethyl sulfate instead of with benzyl chloride.

EXAMPLE 11

Example 10 is repeated, except that the retarder used is a reaction product of 2.5 moles of ethylene oxide and 1 mole of stearylamine. This product is a commercially available temporary retarder.

Figure 3:
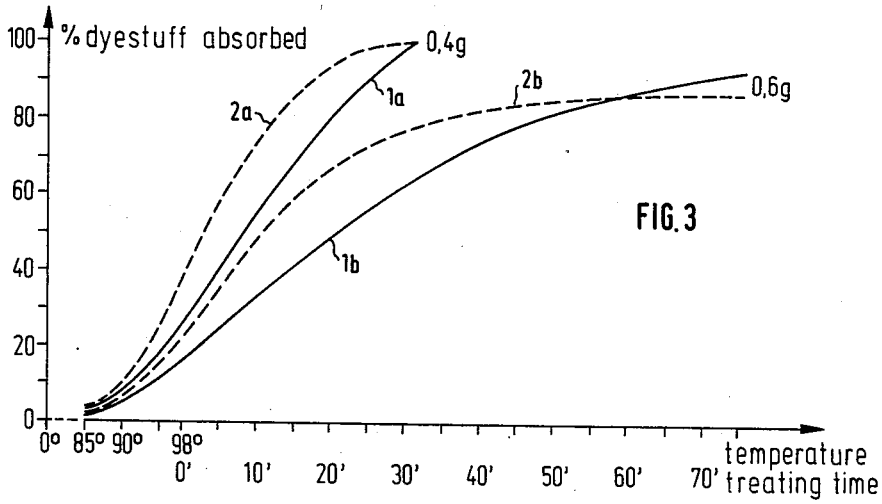

The rate at which the dyestuff exhausts onto the fiber is shown in the graph of FIG. 3 (curves 1*a* and 1*b* with the product according to the invention, and curves 2*a* and 2*b* with the prior art product). The differences in the rates at which the dyestuff exhausts onto the fiber show that the retarder and/or the leveling agent of the present invention makes the course of the dyeing more uniform.

When used in higher concentrations, the retarder and/or leveling agent of the present invention provides evidence that it has considerable temporary characteristics.

EXAMPLE 12

10 g of a polyacrylonitrile fiber are boiled for 30 minutes in a dyeing liquor of 400 cc of water which contain 0.50 g of the retarder of Example 2. After this treatment, the fibers are washed for 10 minutes in water at 40° C., and are then boiled for 45 minutes in a dyeing liquor which contains 0.25 g of Basic Red 18 and 0.5 cc of acetic acid.

A further 10 g of the fiber are treated in parallel fashion at the boil, also for 45 minutes, in a dyeing liquor of 400 cc of water which contains 0.50 g of the retarder of Example 2, 0.25 g of Basic Red 18 and 0.5 cc of acetic acid.

The rate at which the dyestuff exhausts onto the fiber is virtually the same in the two kinds of treatment. This demonstrates the permanence of the compounds according to the invention, since a temporary retarder would be eliminated at the intermediate wash, while the parallel rates of dyeing clearly show that the retarder is bonded firmly and completely to the fiber.

We claim:

1. A method for dyeing polyacrylonitrile or anionically-modified polyester fiber while controlling the rate of dyeing, comprising the step of carrying out the dyeing of the polyacrylonitrile or anionically-modified polyester fiber in the presence of a retarding or leveling agent comprising a quaternary alkoxyalkylammonium compound corresponding to the following general formulas, (I), (II), or (III),

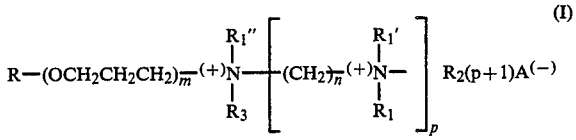

(I)

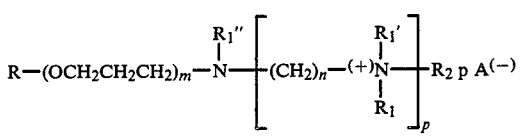

(II)

and

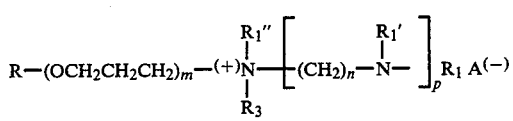

(III)

in which R denotes $C_8$–$C_{20}$-alkyl or -alkenyl, $R_1$, $R'_1$ and $R''_1$, which can be identical or different, denote methyl, ethyl or benzyl and at least one of the radicals $R_1$, $R'_1$ and $R''_1$ denotes a group of the formula $-(C_SH_{2S}O)_xH$, $R_2$ and $R_3$, which can be identical or different, denote methyl, ethyl or benzyl, m denotes 0 or 1, n denotes 2 or 3, p denotes 1, 2 or 3, S denotes 2 or 3, x denotes 1, 2, 3 or 4, and A denotes a halide, methosulfate, ethosulfate or methophosphate ion.

2. A method according to claim 1, wherein R denotes $C_{12}$–$C_{18}$-alkyl or -alkenyl.

3. A method according to claim 1, wherein said fiber is polyacrylonitrile fiber.

4. A method according to claim 1, wherein said retarding or leveling agent comprises a mixture of said quaternary alkoxyalkylammonium compounds.

* * * * *